US010433627B2

(12) United States Patent
Hays et al.

(10) Patent No.: US 10,433,627 B2
(45) Date of Patent: Oct. 8, 2019

(54) PROTECTIVE APPARATUS FOR LUGGAGE

(71) Applicant: Hays, Inc., Onsted, MI (US)

(72) Inventors: Gregory Hays, Onsted, MI (US); Julia Hays, Onsted, MI (US)

(73) Assignee: Hays, Inc., Onsted, MI (US)

( * ) Notice: Subject to any disclaimer, the term of this patent is extended or adjusted under 35 U.S.C. 154(b) by 67 days.

(21) Appl. No.: 15/790,934

(22) Filed: Oct. 23, 2017

(65) Prior Publication Data

US 2019/0116951 A1 Apr. 25, 2019

(51) Int. Cl.
*A45C 13/10* (2006.01)
*A45C 13/00* (2006.01)

(52) U.S. Cl.
CPC ..... *A45C 13/002* (2013.01); *A45C 13/10* (2013.01); *A45C 2013/1015* (2013.01)

(58) Field of Classification Search
CPC ..... A45C 13/002; A45C 2013/1015; A45C 13/10; B65D 65/00; B65D 65/02
USPC ..... 190/26; 150/105, 154; 206/401
See application file for complete search history.

(56) References Cited

U.S. PATENT DOCUMENTS 1,731,547 A * 10/1929 Stansbury ..... A45C 13/36 190/115
3,752,312 A 8/1973 Soltanoff
5,134,974 A 8/1992 Houser
5,255,765 A * 10/1993 Schrecongost ..... A45C 13/002 150/154
5,439,153 A * 8/1995 Murdoch ..... A45C 13/002 150/159
5,486,659 A 1/1996 Rosenbush
5,531,059 A 7/1996 Dickinson
5,820,142 A 10/1998 Duer
5,887,407 A 3/1999 Watkins
6,491,996 B2 12/2002 Digangi
7,441,641 B2 10/2008 Beakey
8,113,381 B2 * 2/2012 Che ..... B65H 35/10 206/233
8,360,498 B1 1/2013 Ostad et al.
8,418,659 B2 4/2013 Harruna
9,004,119 B2 * 4/2015 Piper ..... A45C 3/08 150/105
9,452,905 B2 9/2016 Muderlak et al.
10,182,633 B1 * 1/2019 Giovanni ..... A45C 13/36
(Continued)

FOREIGN PATENT DOCUMENTS

WO WO-2014108107 A1 * 7/2014 ..... A45C 13/002

*Primary Examiner* — Sue A Weaver
(74) *Attorney, Agent, or Firm* — Young Basile Hanlon & MacFarlane, P.C.

(57) ABSTRACT

A luggage protection apparatus can include a body having a recess and an opening providing access to the recess. An attachment member can be connected to the body, where the attachment member is configured to couple the body to luggage. A plurality of protective sheets can be stored in the recess of the body and the plurality of protective sheets can be removably connected in series. Each protective sheet can be sized and shaped to cover a bottom surface of luggage. An external protective sheet can have a proximal end removably connected to the plurality of protective sheets. The external protective sheet can also have a free distal end configured to removably connect to the attachment member, where the free distal end is located opposite the proximal end.

20 Claims, 6 Drawing Sheets

(56) References Cited

U.S. PATENT DOCUMENTS

| | | | | |
|---|---|---|---|---|
| 2001/0048235 | A1 | 12/2001 | Hartranft | |
| 2004/0135407 | A1 | 7/2004 | Hunter et al. | |
| 2004/0144796 | A1 | 7/2004 | Wang et al. | |
| 2004/0206431 | A1 | 10/2004 | Metzig et al. | |
| 2010/0032065 | A1 | 2/2010 | Kelly et al. | |
| 2013/0248554 | A1* | 9/2013 | Robin | B65D 85/671 221/185 |
| 2014/0124107 | A1* | 5/2014 | Archer | A45C 13/002 150/154 |
| 2014/0166418 | A1 | 6/2014 | Licciardino | |
| 2014/0265421 | A1 | 9/2014 | Chang | |
| 2017/0325556 | A1* | 11/2017 | Chickara | A45C 13/002 |

* cited by examiner

PROTECTIVE APPARATUS FOR LUGGAGE

TECHNICAL FIELD

This disclosure relates to a protective apparatus for luggage, and in particular, to disposable sanitary protection for luggage.

BACKGROUND

Business people, students, users of transportation, professionals, and other users of luggage often place their briefcases, boxes, totes, cases, backpacks, suitcases, coolers, purses, shoulder bags, duffel bags, satchels, or gas tanks on unsanitary surfaces like public sidewalks or bathrooms. Such surfaces can contribute to wear and tear of the luggage and can contain dirt, debris, bacteria, liquids, and other contaminants that soil the luggage.

SUMMARY

To place luggage on an unsanitary surface, a luggage protection apparatus is desirable. Due to a variety of locations where luggage users place luggage and the temporary nature of luggage storage in these locations, it is desirable for such an apparatus to quickly switch between protected and unprotected configurations. The portion of the luggage protection apparatus in contact with the unsanitary surface can also become contaminated after use. It is therefore also desirable that the portion of the luggage protection apparatus contaminated after use be easily removable and disposable.

Disclosed herein are implementations of luggage protection apparatuses. The luggage protection apparatus can include a body having a recess and an opening providing access to the recess. A dispenser can be connected to the body inside the recess. The luggage protection apparatus can include an attachment member connected to the body, where the attachment member is configured to couple the body to luggage. The attachment member can include a first portion located on an opposite side of the luggage from the body. A plurality of protective sheets can be removably coupled to the dispenser and the plurality of protective sheets can be removably connected in series. Each protective sheet can be sized and shaped to cover a bottom surface of luggage. An external protective sheet can have a proximal end removably connected to the plurality of protective sheets. The external protective sheet can also have a free distal end configured to removably connect to the first portion of the attachment member, where the free distal end is located opposite the proximal end.

In some implementations, the luggage protection apparatus can include a body having a recess and an opening providing access to the recess. An attachment member can be connected to the body, where the attachment member is configured to couple the body to luggage. A plurality of protective sheets can be removably connected in series and stored in the recess of the body. Each protective sheet can include a perforated end between consecutive protective sheets. The luggage protection apparatus can include an unprotected configuration in which the plurality of protective sheets are stored inside the recess of the body. The luggage protection apparatus can also include a protected configuration in which an external protective sheet is external to the recess and is removably connected to the plurality of protective sheets stored in the recess of the body. In the protected configuration, the external protective sheet can also cover a bottom surface of the luggage.

In other implementations, the luggage protection apparatus can include a body having a recess and an opening providing access to the recess. A flap can be connected to the body and movable between a closed position, where the opening is closed and the recess is not accessible, and an open position, where the opening is open and the recess is accessible. An attachment member can be connected to the body, where the attachment member is configured to couple the body to luggage. A plurality of protective sheets can be removably connected in series and stored inside the recess of the body. Each protective sheet can include two perforated ends located opposite each other, where each of the two perforated ends has an aperture. Each protective sheet can include a first wing extending from the protective sheet on a side of the protective sheet that is not one of the two perforated ends. Each protective sheet can also include a second wing extending from the protective sheet, where the second wing is located opposite the first wing. Each protective sheet can be sized and shaped to cover a bottom surface of luggage. The luggage protection apparatus can include an external protective sheet having a proximal end and a free distal end located opposite the proximal end. The luggage protection apparatus can also include an unprotected configuration in which the protective sheets are stored inside the recess of the body and the flap is in the closed position. In a protected configuration, the external protective sheet can be external to the recess and can be connected at the proximal end of the external protective sheet to the plurality of protective sheets stored inside the recess. In the protected configuration, the flap can extend through the aperture, the flap being in the closed position to retain the plurality of protective sheets in the recess. In the protected configuration, the free distal end of the external protective sheet can be removably connected to a first portion of the attachment member located on a side of the luggage that is opposite the body. In the protected configuration, the first wing of the external protective sheet can be removably connected to a second portion of the attachment member. In the protected configuration, the second wing of the external protective sheet can also be removably connected to a third portion of the attachment member on a side of the luggage that is opposite the second portion of the attachment member.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
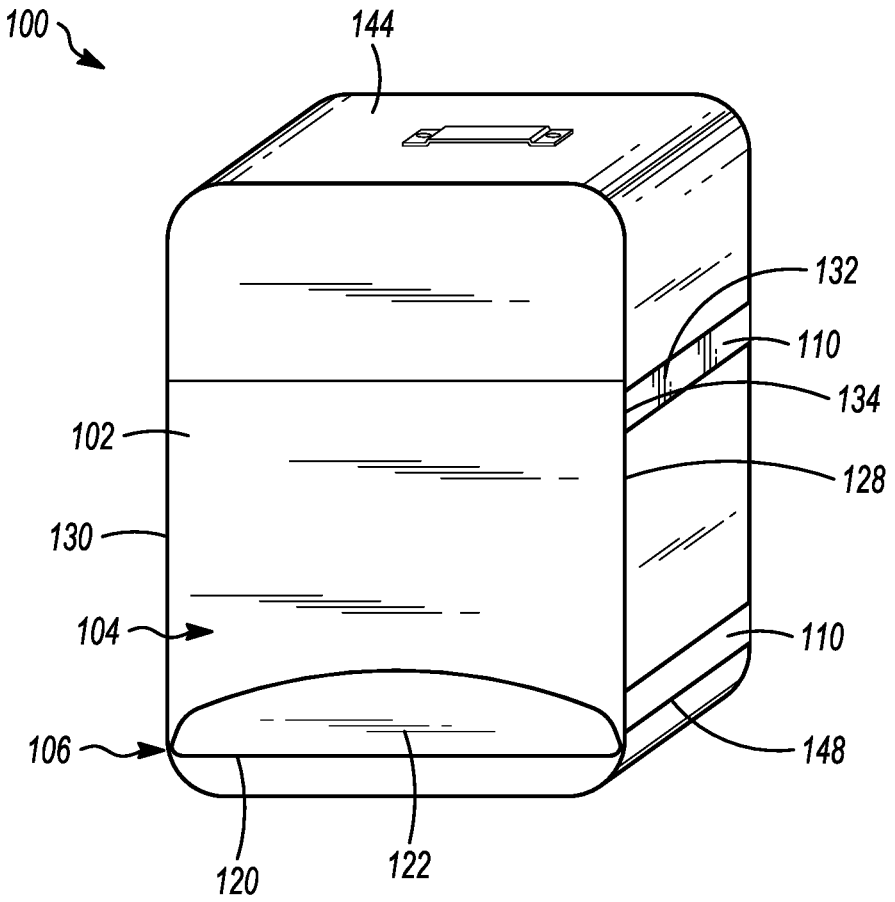
FIG. 1 is a perspective view of front and right sides of an implementation of a luggage protection apparatus coupled to luggage.

FIGS. 1-7 illustrate aspects of luggage protection apparatuses that are adapted to be used in a variety of locations, including locations that otherwise lack a sterile surface for a user to place their luggage. Luggage can include any bag or container such as briefcases, boxes, totes, cases, backpacks, suitcases, coolers, purses, shoulder bags, duffel bags, satchels, or gas tanks. A user can include any person transporting such a bag or container. As shown in FIG. 1, a luggage protection apparatus 100 can include a body 102 having a recess 104 and an opening 106 providing access to the recess 104. A dispenser 108 can be connected to the body 102 inside of the recess 104. An attachment member 110 can be connected to the body 102. A plurality of protective sheets 112 can be removably coupled to the dispenser 108. An external protective sheet 114 can have a free distal end 116 configured to removably connect to the attachment member 110 and a proximal end 118 removably connected to the plurality of protective sheets 112. In some implementations, the luggage protection apparatus can include an unprotected configuration and a protected configuration.

The body 102 can have a recess 104 and an opening 106. The dispenser 108 and the plurality of protective sheets 112 can be retained inside the recess 104 of the body 102. The opening 106 to the recess 104 can be located on a bottom edge 120 of the body 102. In other implementations, the opening 106 to the recess 104 can be located on any other edge of the body 102. The opening 106 can also be located on the body 102 in a position other than an edge of the body 102. The body 102 can be of a rectangular prismatic shape. In other implementations, the body 102 can have any other prismatic shape or be of an amorphous shape. The body 102 can be a bag comprised of cotton, vinyl, canvas, denim, nylon, polyester, or any other suitable fabric. In some implementations, the body can be a container comprised of any plastic, wood, metal, or other suitable non-fabric material. The body 102 can also be comprised of any combination of fabric and non-fabric materials. Each plastic sheet can be sized and shaped to cover a bottom surface of luggage, so the size of the body 102 and recess 104 can vary depending on the size of the luggage being protected by the luggage protection apparatus 100.

Figure 2:
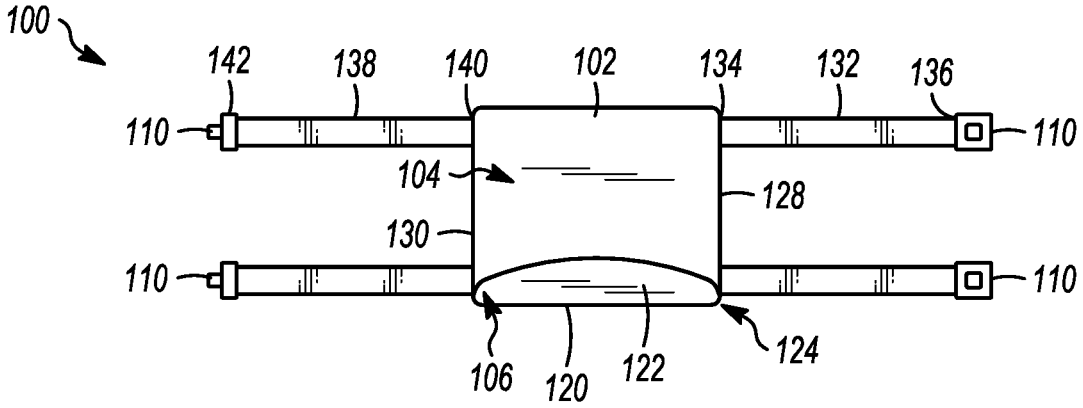
FIG. 2 is a front plan view of the implementation of the luggage protection apparatus where a flap is in a closed position.
Figure 3:
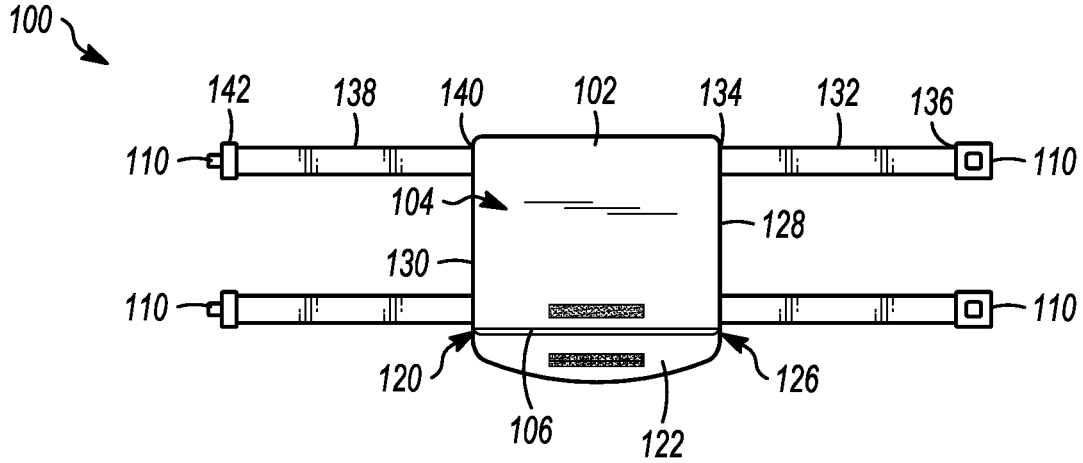
FIG. 3 is a front plan view of the implementation of the luggage protection apparatus where the flap is in an open position.

The luggage protection apparatus 100 can include a flap 122 connected to the body 102 and movable between a closed position 124, shown in FIG. 2, and an open position 126, shown in FIG. 3. In the closed position 124, the opening 106 is closed and the recess 104 is not accessible. The flap 122 can be held in the closed position 124 with hook and loop fasteners. In other implementations, the flap 122 can be held in the closed position 124 with mechanical fasteners other than hook and loop fasteners. Such fasteners could include hooks, buttons, snap fasteners, rivets, interference fit, or any other known means of mechanical connection. In the open position 126, the opening 106 is open and the recess 104 is accessible. In the closed position 124, the flap 122 can retain the plurality of protective sheets 112 in the recess 104 of the body 102. In the open position 126, a user can have access to the plurality of protective sheets 112 stored in the recess 104 through the opening 106.

The flap 122 can span the entire width of the body 102 and restrict access to the opening 106. In other implementations, the flap 122 can span a portion of the width of the body 102 and partially restrict access to the opening 106. The flap 122 can have be of any shape, including but not limited to ovular, rectangular, square, elliptical, or oblong. When in the closed position 124, the flap 122 can span any length of the body 102. The flap 122 can be made of cotton, vinyl, canvas, denim, nylon, polyester, or any other suitable fabric. In other implementations, the flap 122 can be made of another material such as plastic. The flap 122 can be made of the same or different material than the body 102.

Figure 4:
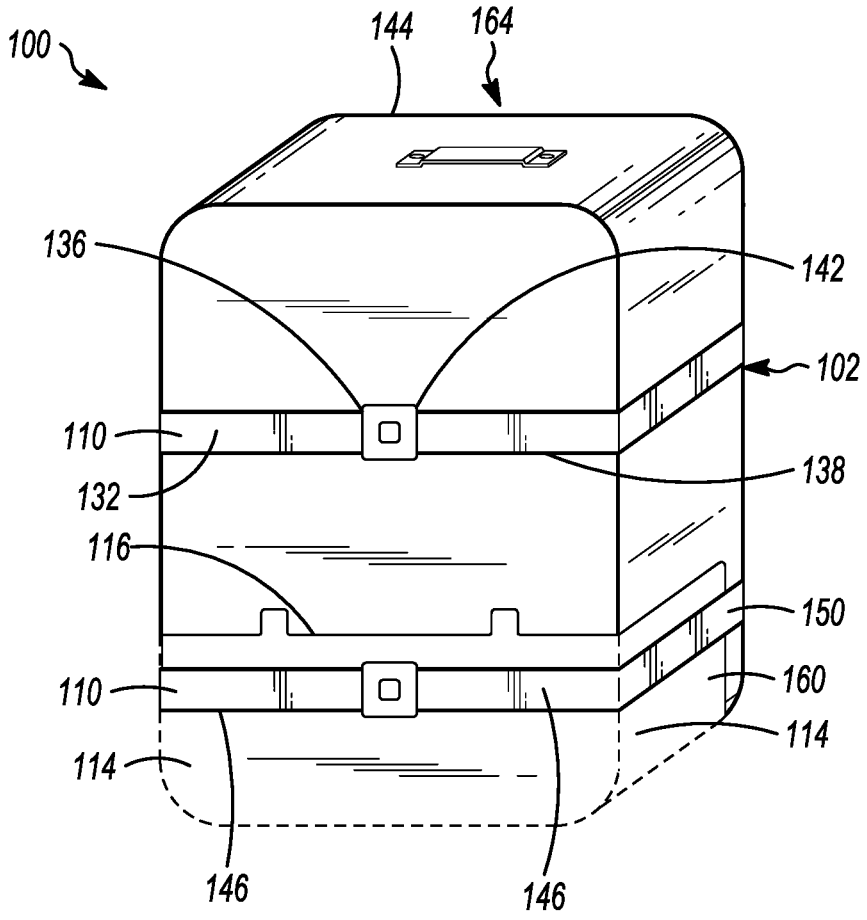
FIG. 4 is a perspective view of back and left sides of the implementation of the luggage protection apparatus coupled to luggage.

As shown in FIGS. 2 and 3, the attachment member 110 connected to the body 102 can be configured to couple the body 102 to luggage. In one implementation, the body 102 can include a first side 128 and a second side 130 located opposite the first side. In this implementation, the attachment member 110 can include a first strap 132 having a proximal end 134 and a distal end 136, where the proximal end 134 is connected to the first side 128 of the body and the distal end 136 extends away from the body 102. The attachment member 110 can further include a second strap 138 having a proximal end 140 and a distal end 142, where the proximal end 140 is connected to the second side 130 of the body 102 and the distal end 142 extends away from the body 102. The distal end 136 of the first strap 132 and the distal end 142 of the second strap 138 can be removably connected. In this implementation, the body 102 of the luggage protection apparatus 100 can be placed against a suitcase 144 as shown in FIG. 1. The first and second straps 132, 138 of the attachment member 110 can be placed around the suitcase 144 and the distal ends 136, 142 of the first and second straps can be connected, coupling the body 102 to the suitcase 144 as shown in FIG. 4. As shown in FIG. 4, the attachment member 110 can include a first portion 146 located on an opposite side of the luggage from the body 102. The first portion 146 can be located on the side of the suitcase 144 where the distal ends 136, 142 of the first and second straps 132, 138 are connected. The attachment member 110 can also have a second portion 148, shown in FIG. 1, and a third portion 150, shown in FIG. 4, on a side of the luggage that is opposite the second portion 148 of the attachment member 110.

The first and second straps 132, 138 can be comprised of straps, string, cords, ropes, bands, or any other elongate member capable of being placed around luggage. The straps can be comprised of any fabric, plastic, rubber, or other suitable material and can be elastic, inelastic, flexible, or inflexible. The distal ends 136, 142 of the first and second straps can be connected using buckles of any type, magnets, strap adjusters, slide and loop connectors, snap hooks, cord locks, or any other suitable connector. In other implementations, the attachment member 110 can comprise more than one set of first and second straps 132, 138 that can be placed around luggage and connected as shown in FIG. 1. The first and second straps 132, 138 can also be coupled to the luggage using adhesive, rivets, snap connectors, buttons, or any other known means of mechanical connection. The attachment member 110 could also comprise one or more elastic, continuous straps without connectors that can be placed around the luggage, coupling the body 102 to the luggage. In some implementations, the first and second straps 132, 138 can connect the attachment member 110 to the body 102 by means other than by placing the first and second straps 132, 138 around the luggage. For example, the straps can be placed around a portion of the luggage, including a handle, zipper, or pocket of the luggage. In other implementations, the body 102 can be connected to the luggage without straps. In such implementations, the attachment member 110 can couple the body 102 to the luggage using adhesive, hooks, buttons, rivets, snap fasteners, hook and loop fasteners, interference fit, stitching, or any other known means of mechanical connection.

The plurality of protective sheets 112 can be stored in the recess 104 of the body 102. In one implementation, the flap 122 can be opened and the plurality of protective sheets 112 can be placed into the recess 104 through the opening 106 for storage. This allows the user to replace the plurality of protective sheets 112 when none are left for use. The flap 122 can be closed to retain the plurality of protective sheets 112 inside the recess 104 of the body 102. The plurality of protective sheets 112 can also be removably coupled to the dispenser 108 while the dispenser is coupled to the body 102.

Figure 5:
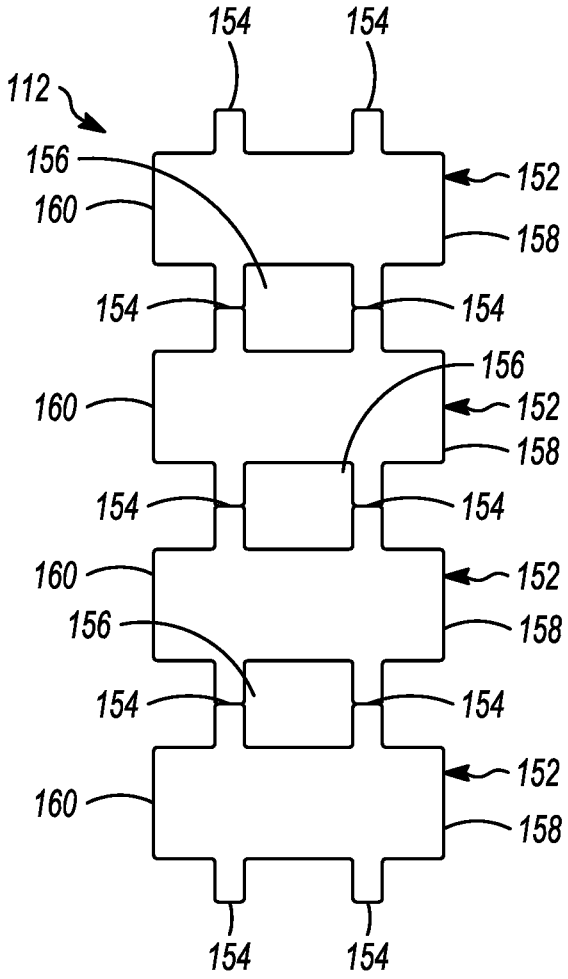
FIG. 5 is a plan view of a plurality of protective sheets connected in series.

As shown in FIG. 5, The plurality of protective sheets 112 can be removably connected in series and each protective sheet 152 can include two perforated ends 154 located opposite each other. In other words, each protective sheet 152 can include a perforated end 154 between consecutive protective sheets in the series. Because each protective sheet 152 has two perforated ends, the plurality of protective sheets 112 can be comprised of singular protective sheets removably connected perforated-end to perforated-end. This allows the user to use one protective sheet at a time while the plurality of protective sheets 112 stays stored in the recess 104 of the body 102 or coupled to the dispenser 108. After use, each protective sheet 152 can be removed from the plurality of protective sheets 112 by its perforated end 154. In other implementations, the plurality of protective sheets 112 can be comprised of one continuous sheet that can be cut by the user or by the dispenser 108.

As shown in FIG. 5, each perforated end 154 can have an aperture 156. The shape of the aperture 156 can including but is not limited to round, triangular, square, rectangular, ovular, elliptical, or any other polygonal shape. Each protective sheet 152 can also include a first wing 158 extending from the protective sheet 152 on a side of the protective sheet 152 that is not one of the two perforated ends 154. Each protective sheet 152 can additionally include a second wing 160 extending from the protective sheet 152, where the second wing 160 is located opposite the first wing 158. The first wing and second wing 158, 160 can have the identical or varied dimensions in relation to each other. The first wing and second wing 158, 160 can span the entire width of each protective sheet 152 or a portion of the width of each protective sheet 152. The first wing and second wing 158, 160 can also have a length greater than, equal to, or lesser than the length of each protective sheet 152. The first wing and second wing 158, 160 can also form identical or varied shapes. The first wing and second wing 158, 160 can be round, triangular, square, rectangular, ovular, elliptical, or any other polygonal shape. In some implementations, each protective sheet 152 of the plurality of protective sheets 112 and the external protective sheet 114 can have no aperture 156, no first wing 158, nor the second wing 160. Each protective sheet 152 can also have any number of wings or apertures. Each protective sheet 152 can be sized and shaped to cover a bottom surface of luggage. In some implementations, each protective sheet 152 can be of any size or shape suitable to cover a bottom surface of luggage, including but not limited to round, triangular, square, rectangular, ovular, elliptical, or any other polygonal shape. Each protective sheet 152 can also possess a shape customized to cover the bottom surface of a specific article of luggage. Each protective sheet 152 can be comprised of any variety of paper or paper towel, metal or metal foil, plastic, or fabric.

Figure 6:
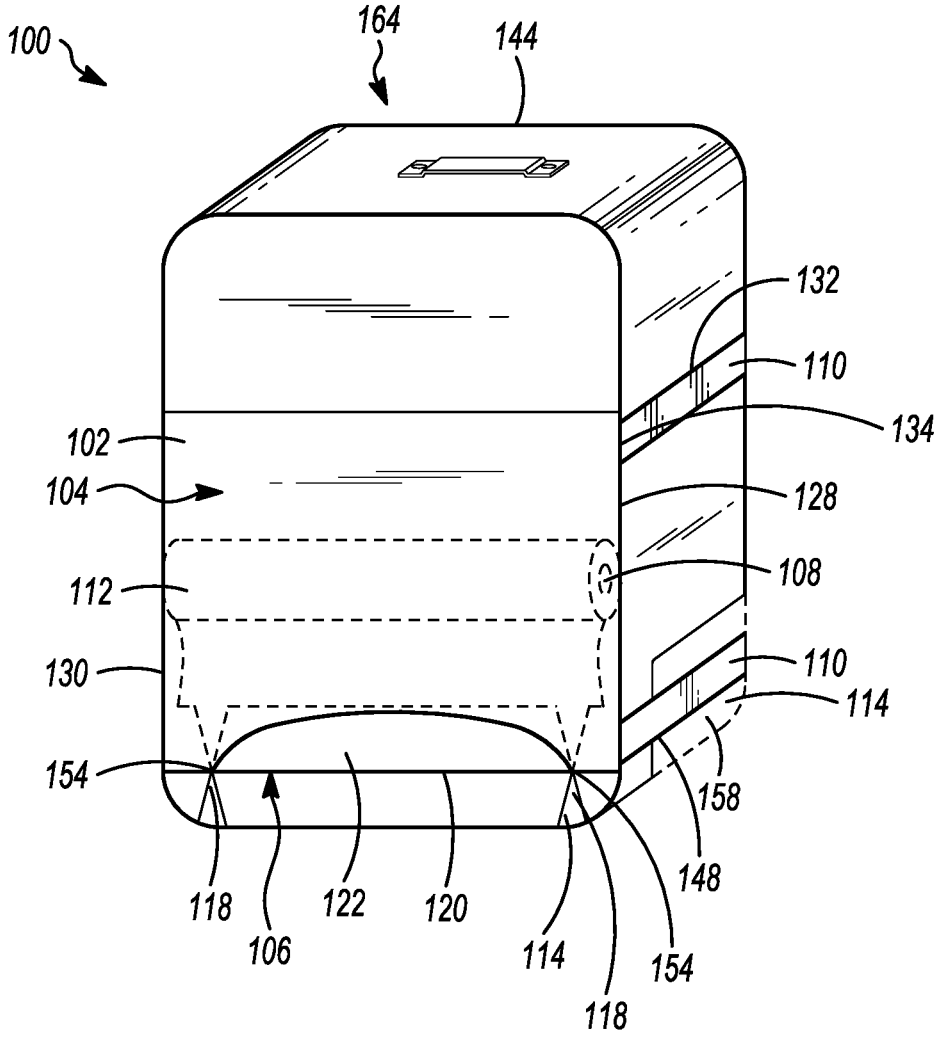
FIG. 6 is a perspective view of front and right sides of the implementation of the luggage protection apparatus coupled to luggage, where the luggage protection apparatus is in a protected configuration.

In some implementations, the user can remove one protective sheet from the recess 104 through the opening 106 while the one protective sheet remains connected to the plurality of protective sheets 112. Once the one protective sheet is removed from the recess 104, that one protective sheet is the external protective sheet 114. the external protective sheet 114 can be used to cover the bottom surface of the luggage. The external protective sheet 114 can be used to protect the luggage from external surfaces, wear and tear, dirt, debris, bacteria and any other disease causing microorganisms, liquids, and any other contaminants. FIGS. 4 and 6 show the external protective sheet 114 covering the bottom surface of the suitcase 144. As shown in FIG. 6, the external protective sheet 114 can have a proximal end 118 removably connected to the plurality of protective sheets 112. The dashed lines of FIG. 6 illustrate the plurality of protective sheets 112 inside the recess 104 of the body 102 and the surfaces of the suitcase 144 covered by the external protective sheet 114. The external protective sheet 114 can have a free distal end 116 configured to removably connect to the first portion 146 of the attachment member 110 where the free distal end 116 is located opposite the proximal end 118, to hold the external protective sheet 114 in place on the luggage. FIG. 4 illustrates the free distal end 116 of the external protective sheet 114 removably connected to the first portion 146 of the attachment member 110. The dashed lines of FIG. 4 illustrate the surfaces of the suitcase 144 covered by the external protective sheet 114. The free distal end 116 of the external protective sheet 114 can removably connect to the first portion 146 of the attachment member 110 by any known means of mechanical attachment, including but not limited to hook and loop fasteners, hooks, buttons, snap fasteners, rivets, interference fit, or tucking the external protective sheet 114 into the attachment member 110.

In some implementations, the first wing 158 of the external protective sheet 114 can be removably connected to a second portion 148 of the attachment member 110 as shown in FIG. 6. The second wing 160 of the external protective sheet 114 can be removably connected to the third portion 150 of the attachment member 110 on a side of the luggage that is opposite the second portion 148 of the attachment member 110 as shown in FIG. 4. The first wing 158 and second wing 160 of the external protective sheet 114 can removably connect to the second and third portions 146, 148 of the attachment member 110 by any known means of mechanical attachment, including but not limited to hook and loop fasteners, hooks, buttons, snap fasteners, rivets, interference fit, and tucking the external protective sheet 114 into the attachment member 110 to hold the first and second wings 158, 160 in place on the luggage.

Figure 7:
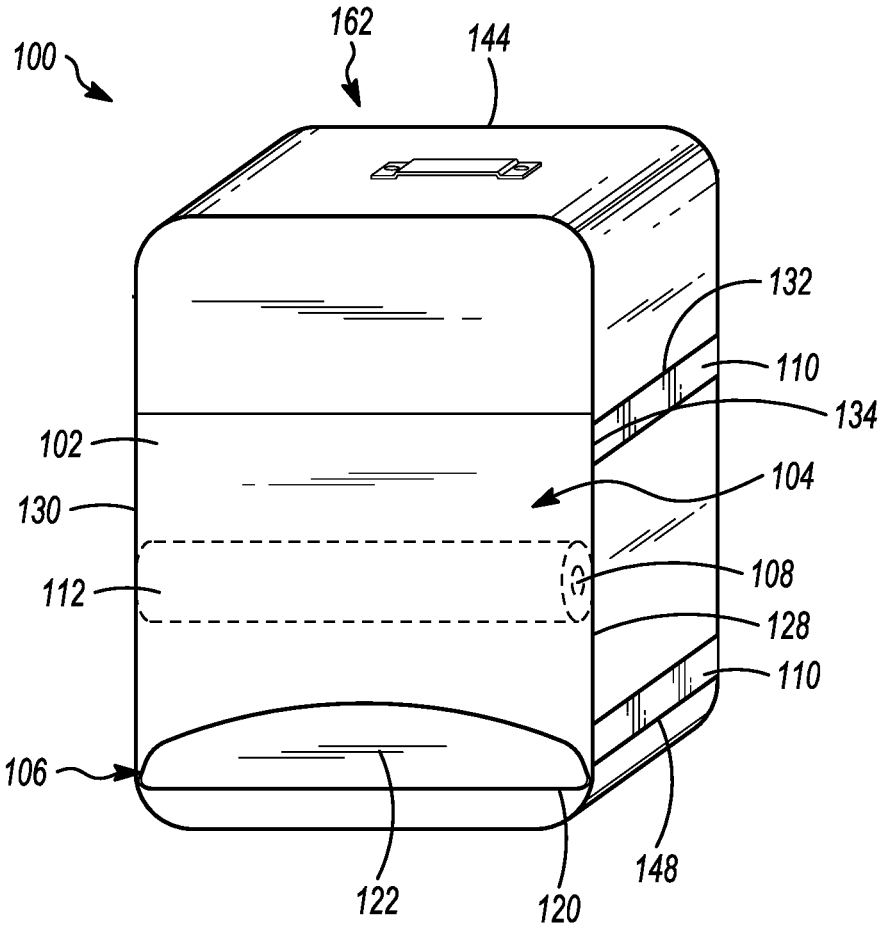
FIG. 7 is a perspective view of front and right sides of the implementation of the luggage protection apparatus coupled to luggage, where the luggage protection apparatus is in an unprotected configuration.

As shown in FIG. 7, the dispenser 108 can be connected to the body 102 inside the recess 104. The plurality of protective sheets 112 can be retained inside the recess 104 by the dispenser 108. The plurality of protective sheets 112 can also be removably coupled to the dispenser 108. The dashed lines of FIG. 7 illustrate the plurality of protective sheets 112 and the dispenser 108 inside of the recess 104 of the body 102. The dispenser 108 can allow the user to pull one protective sheet from the opening 106 while the one protective sheet remains connected to the plurality of protective sheets 112. In some implementations, the plurality of protective sheets 112 can comprise a roll of protective sheets that rotates about the dispenser 108. In these implementations, the dispenser 108 can remain stationary relative to the roll of protective sheets. The user can pull protective sheets from the roll of protective sheets inside the recess 104, causing the roll of protective sheets to rotate about the dispenser 108. In other implementations, the roll of protective sheets can be coupled to the dispenser 108 so that the roll of protective sheets rotates together with the dispenser 108 when the user pulls protective sheets from the roll of protective sheets. The roll of protective sheets can be removably coupled to the body 102 inside of the recess 104.

The dispenser 108 can be any rod, pin, bar, roller, container, or other known device capable of feeding out the plurality of protective sheets 112 one-by-one. The dispenser 108 can be comprised of any type of wood, metal, plastic, or any combination thereof. The dispenser 108 can feed out the plurality of protective sheets 112 automatically or under the power of the user. Each protective sheet 152 can be removed from the plurality of protective sheets 112 under the power of the user or automatically by the dispenser 108. The dispenser 108 can be removably coupled to the body 102 inside the recess 104 using any type of mounting bracket that allows the user to repeatedly remove and replace the dispenser 108 within the recess 104. In some implementations, once no protective sheets are left in the body 102, the user can remove the dispenser 108 from the recess 104, resupply the dispenser 108 with the plurality of protective sheets 112, and reconnect the dispenser 108 to the body 102 inside of the recess 104.

In the unprotected configuration 162 shown in FIG. 7, the plurality of protective sheets 112 are stored inside the recess 104 of the body 102. In some implementations, the unprotected configuration 162 can further include the flap 122 being in the closed position 124. In the unprotected configuration, each of the protective sheets 152 is stored inside the recess 104 of the body 102 and no external protective sheet 114 covers the bottom surface of the luggage. The unprotected configuration 162 can be used by the user when the user does not want to protect the luggage, such as when the user is carrying, storing, cleaning, transporting, or holding the luggage. The unprotected configuration 162 can also be used when the user places the luggage on a sanitary surface. While the luggage protection apparatus 100 is in the unprotected configuration 162, the plurality of protective sheets 112 can be retained inside the recess 104 of the body 102 by either the dispenser 108 or by the flap 122.

The protected configuration 164, shown in FIGS. 4 and 6, can be used by the user when there is no sanitary or otherwise suitable location to place the user's luggage. Unsanitary and unsuitable locations can include bathroom surfaces, public roads and sidewalks, any surface containing moisture, or any surface containing dirt or debris. The protected configuration 164 can be used to protect the luggage from external surfaces, wear and tear, dirt, debris, bacteria and any other disease causing microorganisms, liquids, and any other contaminants. In the protected configuration 164, the external protective sheet 114 is external to the recess 104 and is removably connected to the plurality of protective sheets 112 stored in the recess 104 of the body 102. In the protected configuration 164, the external protective sheet 114 also covers the bottom surface of the luggage. The protected configuration 164 can further include leaving the flap 122 in the open position 126. If the flap 122 is in the open position, the plurality of protective sheets 112 can be retained inside the recess 104 by the dispenser 108. The protected configuration 164 can include removably connecting the external protective sheet 114 to the attachment member 110. The external protective sheet 114 can be removably connected to the attachment member 110 by any known means of mechanical attachment, including but not limited to adhesive, hook and loop fasteners, hooks, buttons, snap fasteners, rivets, interference fit, or tucking the external protective sheet 114 into the attachment member 110. In other implementations, the protected configuration 164 can include removably connecting the external protective sheet 114 to the luggage. The external protective sheet 114 can be removably connected to the luggage by any known means of mechanical attachment, including but not limited to adhesive, hook and loop fasteners, hooks, buttons, snap fasteners, rivets, or interference fit.

The protected configuration 164 can vary in other implementations. In some implementations, the external protective sheet 114 can be external to the recess 104 and can be connected at the proximal end 118 of the external protective sheet 114 to the plurality of protective sheets 112 stored in the recess 104. The flap 122 can extend through the aperture 156, the flap 122 being in the closed position 124 to retain the plurality of protective sheets 112 in the recess 104 as shown in FIG. 6. As shown in FIG. 4, the free distal end 116 of the external protective sheet 114 can be removably connected to the first portion 146 of the attachment member 110 located on a side of the luggage that is opposite the body 102. The first wing 158 of the external protective sheet 114 can be removably connected to the second portion 148 of the attachment member 110 as shown in FIG. 6. The second wing 160 of the external protective sheet 114 can be removably connected to a third portion 150 of the attachment member 110 on a side of the luggage that is opposite the second portion 148 of the attachment member 110 as shown in FIG. 4.

By leaving the proximal end 118 of the external protective sheet 114 connected to the plurality of protective sheets 112 in the protected configuration 164, the user can quickly change the luggage protection apparatus from the unprotected configuration 162 to the protected configuration 164. Because the proximal end 118 of the external protective sheet 114 is connected to the plurality of protective sheets retained in the recess 104 by the dispenser 108 or the flap 122, the proximal end 118 is also retained in place by the dispenser 108 or the flap 122 if the flap is in the closed position 124. This minimizes the effort needed from the user to connect the remainder of the external protective sheet 114 to the luggage or the attachment member 110 by the free distal end 116, first wing 158, or second wing 160. The user can therefore quickly couple the external protective sheet 114 to the luggage when temporarily placing the luggage on an unsanitary surface and uncouple the external protective sheet 114 from the luggage when the luggage is removed from the unsanitary surface. By coupling the external protective sheet 114 to the attachment member 110, the luggage requires no mechanical fasters such as hooks, buttons, snap fasteners, adhesives or rivets to couple the external protective sheet 114 to the luggage. This ensures that the luggage can remain free of adhesives and otherwise unmodified. Coupling the external protective sheet 114 to the attachment member 110 also allows the user to quickly switch between the unprotected and protected configurations.

The luggage protection apparatus 100 can also include a disposal configuration in which the external protective sheet 114 is removed from the bottom surface of the luggage and is separated from the plurality of protective sheets 112 stored in the recess 104 of the body 102. The external protective sheet 114 can be separated from the plurality of protective sheets 112 by tearing the external protective sheet 114 from the plurality of protective sheets 112 at the proximal end 118 of the external protective sheet 114. In other implementations, the external protective sheet can be cut or severed from the plurality of protective sheets 112 by the user or by the dispenser 108. Once the user removes the external protective sheet 114 from the bottom surface of the luggage and separates the external protective sheet from the plurality of protective sheets 112, the separated external protective sheet can be disposed of. The disposal configuration can be used after the user no longer wishes to protect the luggage. This an occur after the user removes the luggage from the unsanitary surface.

A method for protecting luggage using the luggage protection apparatus 100 can include coupling the body 102 to the luggage using the attachment member 110. In some implementations, coupling the body 102 to the luggage can comprise placing the first and second straps 132, 138 of the attachment member 110 around the luggage and connecting the distal ends 136, 142 of the first and second straps together on a side of the luggage opposite the body 102. The apparatus 100 is attached so that the flap 122 faces the bottom of the luggage. The method can include moving the flap 122 from the closed to the open position 126, providing the user access to the plurality of protective sheets 112 retained inside the recess 104 of the body 102. In some implementations, the luggage protection apparatus 100 may not include a flap so that the user can have access to the recess 104. In other words, a zipper enclosure may be used as a non-limiting example to access the recess 104. The method can include removing one protective sheet of the plurality of protective sheets 112 from the recess 104 through the opening 106, leaving the one protective sheet connected to the plurality of protective sheets 112. When the one protective sheet is removed from the recess 104, the one protective sheet becomes the external protective sheet 114. The method can include extending the flap 122 through the aperture 156 of the external protective sheet 114. The flap 122 can be moved from the open position 126 to the closed position 124 to retain the plurality of protective sheets 112 inside the recess 104. In other implementations, the flap 122 can be left in the open position 126, and the plurality of protective sheets 112 can be retained in the recess 104 of the body 102 by the dispenser 108. The method can further include coupling the free distal end 116 of the external protective sheet 114 to the first portion 146 of the attachment member 110 located on the side of the luggage opposite the body 102. In some implementations, the free distal end 116 can be coupled to the first portion 146 of the attachment member 110 by tucking the free distal end 116 into the attachment member 110. In other implementations, the method can include coupling the free distal end 116 of the external protective sheet 114 to the luggage. The free distal end 116 can be coupled to the luggage with adhesive in some implementations. The method can include coupling the first wing 158 of the external protective sheet 114 to the second portion 148 of the attachment member 110. The method can include coupling the second wing 160 of the external protective sheet 114 to the third portion 150 of the attachment member 110 located on a side of the luggage that is opposite the second portion of the attachment member. The first and second wings 158, 160 of the external protective sheet 114 can be coupled to the second and third portions 146, 148 of the attachment member 110 by tucking the first and second wings 158, 160 into the attachment member 110. The method can also include uncoupling the external protective sheet 114 from the attachment member 110 when the user does not want to protect the luggage. The external protective sheet 114 can be uncoupled from the attachment member 110 by untucking the free distal end 116, first wing 158, and second wing 160 of the external protective sheet 114 from the first, second and third portions 146, 148, 150 of the attachment member 110 respectively. The method can include disposing of the external protective sheet 114 when the user no longer wishes to protect the luggage.

While the disclosure has been described in connection with certain implementations, it is to be understood that the disclosure is not to be limited to the disclosed implementations but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A luggage protection apparatus, comprising:

a body having a recess and an opening providing access to the recess;

a dispenser connected to the body inside the recess;

an attachment member connected to the body, the attachment member being configured to couple the body to luggage, wherein the attachment member includes a first portion located on an opposite side of the luggage from the body;

a plurality of protective sheets removably coupled to the dispenser, the plurality of protective sheets being removably connected in series, wherein each protective sheet is sized and shaped to cover a bottom surface of luggage; and an external protective sheet having a proximal end removably connected to the plurality of protective sheets and a free distal end configured to removably connect to the first portion of the attachment member, wherein the free distal end is located opposite the proximal end.

2. The apparatus of claim 1, further comprising:

the body having a first side and a second side located opposite the first side; and the attachment member comprising:

a first strap having a proximal end and a distal end, wherein the proximal end is connected to the first side of the body and the distal end extends away from the body; and a second strap having a proximal and a distal end, wherein the proximal end is connected to the second side of the body and the distal end extends away from the body, and wherein the distal end of the first strap and the distal end of the second strap can be removably connected.

3. The apparatus of claim 1, further comprising:

a flap connected to the body and movable between a closed position where the opening is closed and the recess is not accessible and an open position where the opening is open and the recess is accessible.

4. The apparatus of claim 1, wherein each protective sheet further comprises:

two perforated ends located opposite each other;

a first wing extending from the protective sheet on a side of the protective sheet that is not the one of the two perforated ends; and a second wing extending from the protective sheet, the second wing being located opposite the first wing.

5. The apparatus of claim 4, wherein the first wing of the external protective sheet is removably connected to a second portion of the attachment member; and the second wing of the external protective sheet is removably connected to a third portion of the attachment member on a side of the luggage that is opposite the second portion of the attachment member.

6. The apparatus of claim 1, wherein the plurality of protective sheets comprises a roll of protective sheets that rotates about the dispenser.

7. A luggage protection apparatus, comprising:

a body having a recess and an opening providing access to the recess;

an attachment member connected to the body, wherein the attachment member is configured to couple the body to luggage;

a plurality of protective sheets removably connected in series and stored in the recess of the body, each protective sheet including a perforated end between consecutive protective sheets;

an unprotected configuration in which the plurality of protective sheets are stored inside the recess of the body; and a protected configuration in which:

an external protective sheet is external to the recess and is removably connected to the plurality of protective sheets stored in the recess of the body; and the external protective sheet covers a bottom surface of the luggage, wherein the external protective sheet is removably connected to the attachment member.

8. The apparatus of claim 7, further comprising a disposal configuration in which the external protective sheet is removed from the bottom surface of the luggage and is separated from the plurality of protective sheets stored in the recess of the body.

9. The apparatus of claim 7, wherein the plurality of protective sheets comprises a roll of protective sheets removably coupled to the body inside of the recess.

10. The apparatus of claim 9 further comprising a dispenser connected to the body inside of the recess, and wherein the plurality of protective sheets are retained inside the recess by the dispenser.

11. The apparatus of claim 7, further comprising a flap connected to the body and movable between a closed position where the opening is closed and the recess is not accessible and an open position where the opening is open and the recess is accessible.

12. The apparatus of claim 11, wherein the unprotected configuration further comprises the flap being in the closed position.

13. The apparatus of claim 11, wherein the protected configuration further comprises leaving the flap in the open position.

14. The apparatus of claim 7, wherein the protected configuration further comprises removably coupling the external protective sheet to the luggage.

15. The apparatus of claim 7, wherein each protective sheet further comprises:

a first wing extending from the protective sheet on a side of the protective sheet that is not the perforated end; and a second wing extending from the protective sheet, the second wing being located opposite the first wing.

16. The apparatus of claim 15, wherein in the protected configuration, the first wing of the external protective sheet is removably connected to the attachment member; and the second wing of the external protective sheet is removably connected to the attachment member.

17. A luggage protection apparatus, comprising:

a body having a recess and an opening providing access to the recess;

a flap connected to the body and movable between a closed position where the opening is closed and the recess is not accessible and an open position where the opening is open and the recess is accessible;

an attachment member connected to the body, wherein the attachment member is configured to couple the body to luggage;

a plurality of protective sheets removably connected in series and stored inside the recess of the body, each protective sheet including:

two perforated ends located opposite each other, each of the two perforated ends having an aperture;

a first wing extending from the protective sheet on a side of the protective sheet that is not one of the two perforated ends, and a second wing extending from the protective sheet, the second wing being located opposite the first wing, wherein each protective sheet is sized and shaped to cover a bottom surface of luggage;

an external protective sheet having a proximal end and a free distal end located opposite the proximal end;

an unprotected configuration in which the protective sheets are stored inside the recess of the body and the flap is in the closed position; and a protected configuration in which:

the external protective sheet is external to the recess and is connected at the proximal end of the external protective sheet to the plurality of protective sheets stored inside the recess, the flap extends through the aperture, the flap being in the closed position to retain the plurality of protective sheets in the recess, the free distal end of the external protective sheet is removably connected to a first portion of the attachment member located on a side of the luggage that is opposite the body, the first wing of the external protective sheet is removably connected to a second portion of the attachment member, and the second wing of the external protective sheet is removably connected to a third portion of the attachment member on a side of the luggage that is opposite the second portion of the attachment member.

18. The apparatus of claim 17 wherein the protective sheets comprise a roll of protective sheets removably coupled to the body.

19. The apparatus of claim 18, further comprising a dispenser connected to the body inside of the recess, wherein the roll of protective sheets is retained inside the recess by the dispenser and wherein the roll of protective sheets rotates about the dispenser.

20. The apparatus of claim 17 wherein the flap is held in the closed position with hook and loop fasteners.

* * * * *